US006879622B2

(12) United States Patent
Johansson

(10) Patent No.: US 6,879,622 B2
(45) Date of Patent: Apr. 12, 2005

(54) HORIZONTAL ELEMENT ARRANGEMENT MEANS

(75) Inventor: Lars-Goran Johansson, Hallstahammar (SE)

(73) Assignee: Kanthal AB, Hallstahammar (SE)

( * ) Notice: Subject to any disclaimer, the term of this patent is extended or adjusted under 35 U.S.C. 154(b) by 25 days.

(21) Appl. No.: 10/472,747

(22) PCT Filed: Mar. 26, 2002

(86) PCT No.: PCT/SE02/00613

§ 371 (c)(1),
(2), (4) Date: Apr. 19, 2004

(87) PCT Pub. No.: WO02/080621

PCT Pub. Date: Oct. 10, 2002

(65) Prior Publication Data

US 2004/0165644 A1 Aug. 26, 2004

(30) Foreign Application Priority Data

Mar. 29, 2001 (SE) ..... 0101136

(51) Int. Cl.[7] ..... H05B 3/62
(52) U.S. Cl. ..... 373/117
(58) Field of Search ..... 373/117, 127–132, 373/134; 219/520, 532, 536, 538, 539, 542, 544, 546, 548, 549, 550, 552, 553; 338/208, 280, 316; 392/360, 379

(56) References Cited

U.S. PATENT DOCUMENTS

| | | | | | |
|---|---|---|---|---|---|
| 1,652,200 | A | | 12/1927 | Hanson | 373/129 |
| 3,852,568 | A | * | 12/1974 | Clement | 219/532 |
| 3,992,609 | A | * | 11/1976 | Alexander | 219/550 |
| 4,250,399 | A | * | 2/1981 | King | 174/138 J |
| D262,285 | S | * | 12/1981 | Janning | D13/131 |
| 4,363,959 | A | * | 12/1982 | Cottrell et al. | 219/532 |
| 4,504,957 | A | * | 3/1985 | McClelland et al. | 373/130 |
| 4,849,608 | A | * | 7/1989 | Muraoka et al. | 219/536 |
| 5,122,640 | A | * | 6/1992 | Holmes | 219/532 |
| 6,125,134 | A | | 9/2000 | Jonsson et al. | 373/128 |

* cited by examiner

*Primary Examiner*—Tu Hoang
(74) *Attorney, Agent, or Firm*—Merchant & Gould P.C.

(57) ABSTRACT

An arrangement at installation of electrical resistance elements having high operating temperatures, in which arrangement comprises at least one element having a glow zone (3) and support and distance plates (1, 2) to carry the glow zone. The element is corrugated in its lengthwise direction, that the upper corrugations are supported at the tipper edges of vertical supporting plates (1) and that the lower corrugations are supported at distance plates (2) that are arranged between each two adjacent supporting plates (1). The supporting plates (1) and the distance plates (2) are held together by a resilient mounted pull bar (5). The element or the elements are mainly made from molybdenum disilicide.

3 Claims, 2 Drawing Sheets

HORIZONTAL ELEMENT ARRANGEMENT MEANS

CROSS-REFERENCE TO RELATED APPLICATIONS

"Not Applicable"

STATEMENT REGARDING FEDERALLY SPONSORED RESEARCH OR DEVELOPMENT

"Not Applicable"

INCORPORATION-BY-REFERENCE OF MATERIAL SUBMITTED ON A COMPACT DISC

"Not Applicable"

FIELD OF THE INVENTION

The present invention is for a means at installation of electrical resistance elements having high operating temperatures. The invention especially is for a means for elements made from ceramic material. Elements and means of this kind are mainly used for industrial furnaces.

BACKGROUND OF INVENTION

Resistance element made from ceramic material are used at very high operating temperatures., commonly in the interval 1200–1900° C. The operating conditions are often intermittent operation which means that the elements shift between heating and cooling off. At these temperatures the properties of the material is affected so that it becomes softer and more plastic. The changed properties have to be taken into account at the installation as they may cause changes of the shape of the elements and consequently less good function. On certain kinds of elements there may also be formed a surface layer having properties which are different from those of the body of the element material, for example there are formed in an oxidising atmosphere, for example air, a surface layer of silicon dioxide on elements made from molybdenum dioxide.

In order to reduce the undesired effects of the above described conditions elements of this kind are often mounted in special ways, for example hanging or lying on support plates which may be made from aluminium oxide. These means in themselves bring with them some disadvantages as the elements tend to adhere to the supporting means which may cause cracks and broken elements when the elements cool off. In those cases where the supporting plates are arranged with spaces between adjacent plates there is a risk for sagging of the element between the plates which further increases the risks for broken elements. It is also known to place the glow zones of the elements on a bead of sand which means that the elements are free to move when the length of them changes at changing temperature, this often means that the elements dig themselves down into the sand. The maximum element temperature at this kind of installations usually is about 1600° C.

BRIEF SUMMARY OF INVENTION

The present invention is for a means at the installation of high temperature elements by means of which the above described disadvantages of known means may be reduced or eliminated. It is also an object of the invention to increase the active element surface at a given installation surface and so achieve an increased power density.

BRIEF DESCRIPTION OF THE SEVERAL VIEWS OF THE DRAWINGS

The invention will below be described more in detail with reference to the example of an embodiment which is shown in the enclosed figures.

DETAILED DESCRIPTION OF INVENTION

Figure 1:
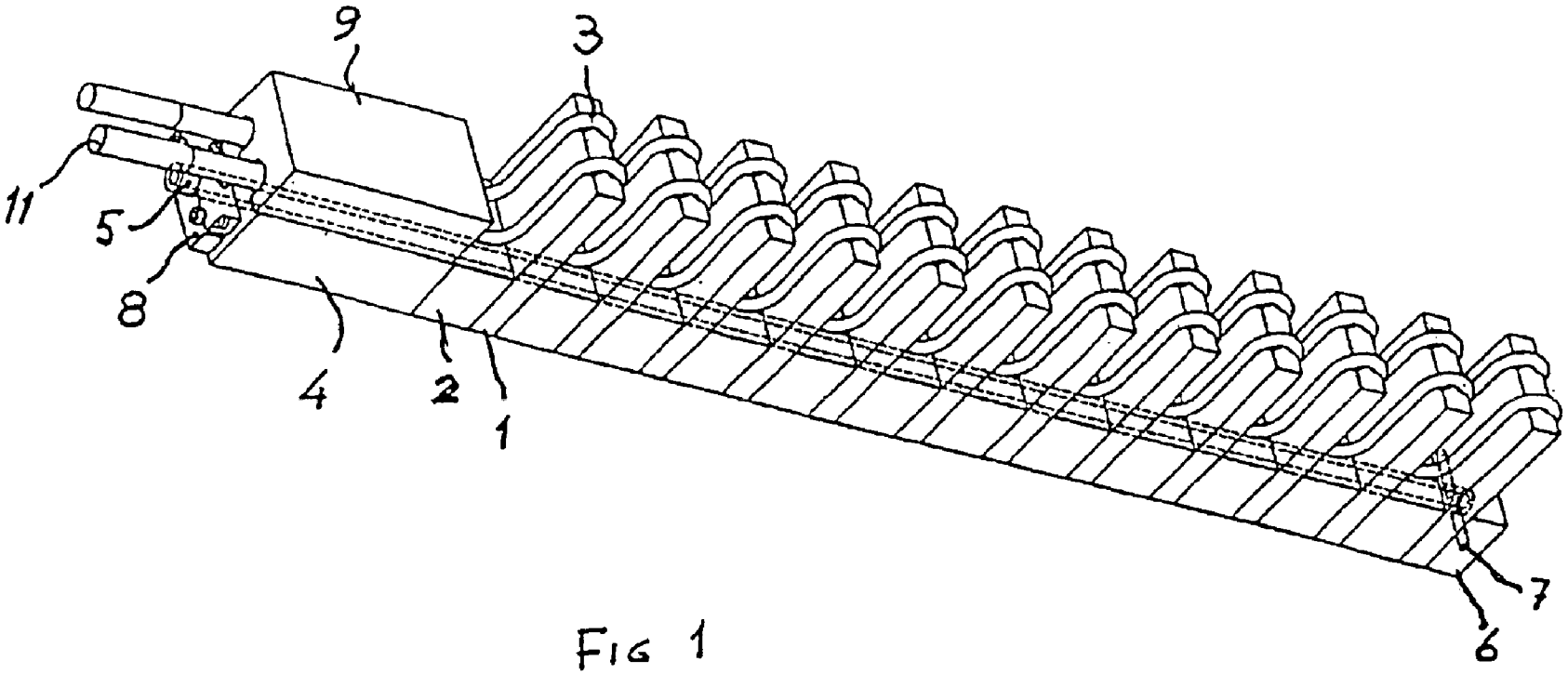
FIG. 1 shows an arrangement according to the invention in perspective view from above.
Figure 2:
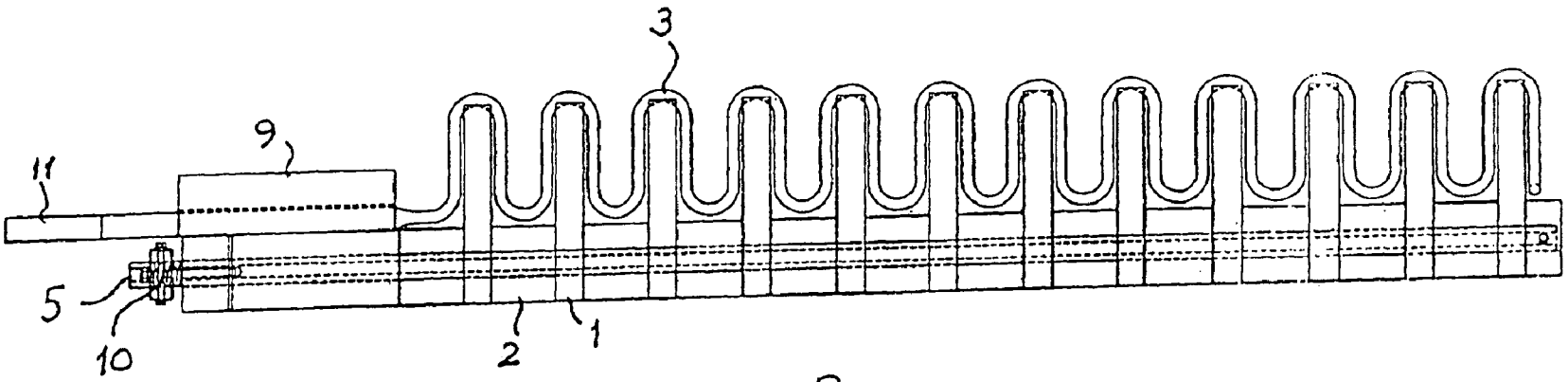
FIG. 2 shows the arrangement of FIG. 1 in side view.

The means that are intended to be supports for the glow zone 3 of the element comprise supporting plates 1 and intermediate distance plates 2. These are arranged in a row so that between to adjacent supporting plates 1 there is a distance plate 2, in the example that is shown in the figures there are twelve supporting plates and twelve distance plates. The arrangement ens at one outer end with a distance plates 4 and, positioned on top of it, a take-through plate9 having holes or grooves to take through the connection parts 11 of the element. The supporting arrangement is held together by a pull bar 5 being a tube or a massive rod, preferably made from silicon carbide, which extends itself all through the arrangement and outside it at the distance plate 4. At the inner end of the arrangement the tube is fixed at a final holding plate 8 by means of a locking pin 7 that extends itself through holes which have been made for this purpose in the holding plate 8 and the tube 5. At the outer end of the arrangement outside the distance plate 4 there is a locking means 6 that resilently clamps the tube 5 and so holds the whole of the supporting arrangement together.

The glow zone 3 of the element is corrugated is its lengthwise direction and shaped like a corrugated U and the straight parts of it follow along the vertical sides of the supporting plates 1. The upper corrugation folds are supported by the upper end of the vertical supporting plates 1 and the lower corrugation folds are hanging freely above the distance plates 2 which are arranged between each two adjacent supporting plates 1. The supporting plates 1 and the distance plates 2 are preferably made from aluminium oxide ceramic. In order to avoid that the element is broken over sharp edges grooves or cutouts corresponding to the outer surface of the element have been made at the upper surfaces or edges of the supporting plates. Compared to a conventional, U-shaped element that is supported in a known manner the temperature of the element may be up to 1700° C. och the working surface of the element is increased up to 150%, which makes a considerable increase of the installed effect possible a given case. The supporting arrangement including the element which is mounted at it form a unit which may, for example, be pushed in at the bottom of a furnace which has suitable grooves or ditches for this purpose. These advantages considerably increase the field of use of ceramic molybdenum disilicide elements.

Within the frame of the inventive idea the embodiment ogf the arrangement may be varied in various ways. In the prefered embodiment which is shown in the figures and described above the free height of the supporting plates 1 above the distance plates 2 is about twice the length of the distance plates, i.e. a relation 2:1. This relation may be changed but is preferably within the range 1.5:2.5, within which range the desired operating conditions and power density can be obtained. The arrangement may also be adapted to other kinds of elements than the simple two shank U shape, for example four shank W shape. Although the arrangement has been developed for ceramic elements of te molybdenum disilicide type and is best adapted to these it is possible to use other kinds of elements for special applications.

What is claimed is:

1. Arrangement at horizontal installation of electrical resistance elements comprising at least one element having a glow zone (3) and support and distance elates (1,2) to carry the glow zone wherein the element is corrugated in its lengthwise direction, wherein upper corrugations are supported at the upper edges of the support plates (1) and lower corrugations hang freely above the distance plates (2) which are arranged between each two adjacent supporting plates (1).

2. Arrangement according to claim 1 wherein the supporting plates (1) and the distance plates (2) are held together by a resilient mounted pull bar (5).

3. Arrangement according to claim 1 wherein the element mainly is made from molybdenum disilicide.

* * * * *